US007814830B2

(12) United States Patent
Rene

(10) Patent No.: US 7,814,830 B2
(45) Date of Patent: Oct. 19, 2010

(54) PRINTING SYSTEM USING SHAPE-CHANGING MATERIALS

(75) Inventor: Marc B. Rene, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 11/268,303

(22) Filed: Nov. 7, 2005

(65) Prior Publication Data

US 2007/0101883 A1 May 10, 2007

(51) Int. Cl.
*B41N 1/00* (2006.01)

(52) U.S. Cl. ..... 101/478; 101/395; 101/401.1

(58) Field of Classification Search ..... 347/103
See application file for complete search history.

(56) References Cited

U.S. PATENT DOCUMENTS 4,005,654 A * 2/1977 Gundlach ..... 101/493
4,445,432 A * 5/1984 Ford et al. ..... 101/152
5,233,921 A * 8/1993 John ..... 101/352.13
6,082,257 A * 7/2000 Secor ..... 101/137
6,092,465 A * 7/2000 Agronin ..... 101/478
6,234,079 B1 * 5/2001 Chertkow ..... 101/395
7,563,388 B2 * 7/2009 Mather et al. ..... 252/299.01
2003/0166840 A1 * 9/2003 Urry et al. ..... 530/350
2005/0068398 A1 * 3/2005 Tanikawa et al. ..... 347/103

* cited by examiner

*Primary Examiner*—Joshua D Zimmerman
(74) *Attorney, Agent, or Firm*—Prass LLP

(57) ABSTRACT

A printing plate suitable for retaining ink in an imagewise fashion on a main surface thereof defines an array of pixel-sized cavities. Each cavity has associated therewith a quantity of a light-induced shape-memory polymer. When a cavity is exposed with energy, such as from an imaging laser, the quantity of polymer changes shape and/or position, thereby allowing a relatively greater quantity of ink to be retained in the cavity. The printing plate is then inked, to from a transferable image. The apparatus as a whole enables a gravure-like printing plate to be repeatedly imaged using digital image data.

28 Claims, 3 Drawing Sheets

PRINTING SYSTEM USING SHAPE-CHANGING MATERIALS

TECHNICAL FIELD

The present disclosure relates to a method of printing images, the method having aspects in common with gravure-type printing, and also having aspects in common with digital printing systems.

BACKGROUND

There are currently two popular basic technologies for the mass production of printed images: offset printing and xerography. Offset printing is currently favored for large volumes of identical prints, such as the pages of magazines and books. One downside of offset printing is that a plate must be prepared for every image desired to be printed, and such plates typically cannot be modified for subsequent use after the particular print job is concluded. In recent years xerography has become cost-effective for somewhat smaller print jobs than are typical with offset printing; and, with laser-based imaging, xerography enables images generated at a computer to be readily printed in large volumes without the hands-on work required in offset.

There have been efforts to make basic offset printing technology adapt to certain imaging techniques that are common in xerography, with some attendant practical advantages. One line of research concerns the making of "flexographic" printing plates, such as described in U.S. Pat. No. 5,279,697, and U.S. Published Patent Application 2005/0150407-A1. Another type of printing technology, within the general realm of offset, includes the use of what are called "Anilox" rolls to retain liquid ink and transfer the ink to a print sheet or blanket roll, such as described in materials published by Harper® Corporation.

Japanese Kokai 11-258785 proposes another method for using digital imaging techniques in a largely offset-based environment.

*Nature*, Vol. 434, pp. 879-882 (14 Apr. 2005) describes what is called a "light-induced shape-memory polymer".

US Published Patent Applications 2004/0081911, now U.S. Pat. No. 7,129,021; 2004/0103801, now U.S. Pat. No. 6,832,554; 2004/0241583, now U.S. Pat. No. 6,989,220; and 2005/0221230, now abandoned, disclose various recent approaches to providing digital imaging, such as through a modulating laser, in a largely offset-based environment.

SUMMARY

According to one aspect, there is provided an apparatus for printing an image, comprising a printing plate. The printing plate defines in a main surface thereof an arrangement of imageable areas, each imageable area being capable of selectably increasing or decreasing an amount of marking material retainable thereat, in response to energy applied thereto.

According to another aspect, there is provided an apparatus for printing an image, comprising a first printing plate and a second printing plate. Each printing plate defines in a main surface thereof an arrangement of imageable areas, each imageable area being capable of selectably increasing or decreasing an amount of marking material retainable thereat, in response to energy applied thereto.

According to another aspect, there is provided a printing plate useful in printing an image, the printing plate defining in a main surface thereof an arrangement of imageable areas, each imageable area being capable of selectably increasing or decreasing an amount of marking material retainable thereat, in response to energy applied thereto.

DETAILED DESCRIPTION

Figure 1:
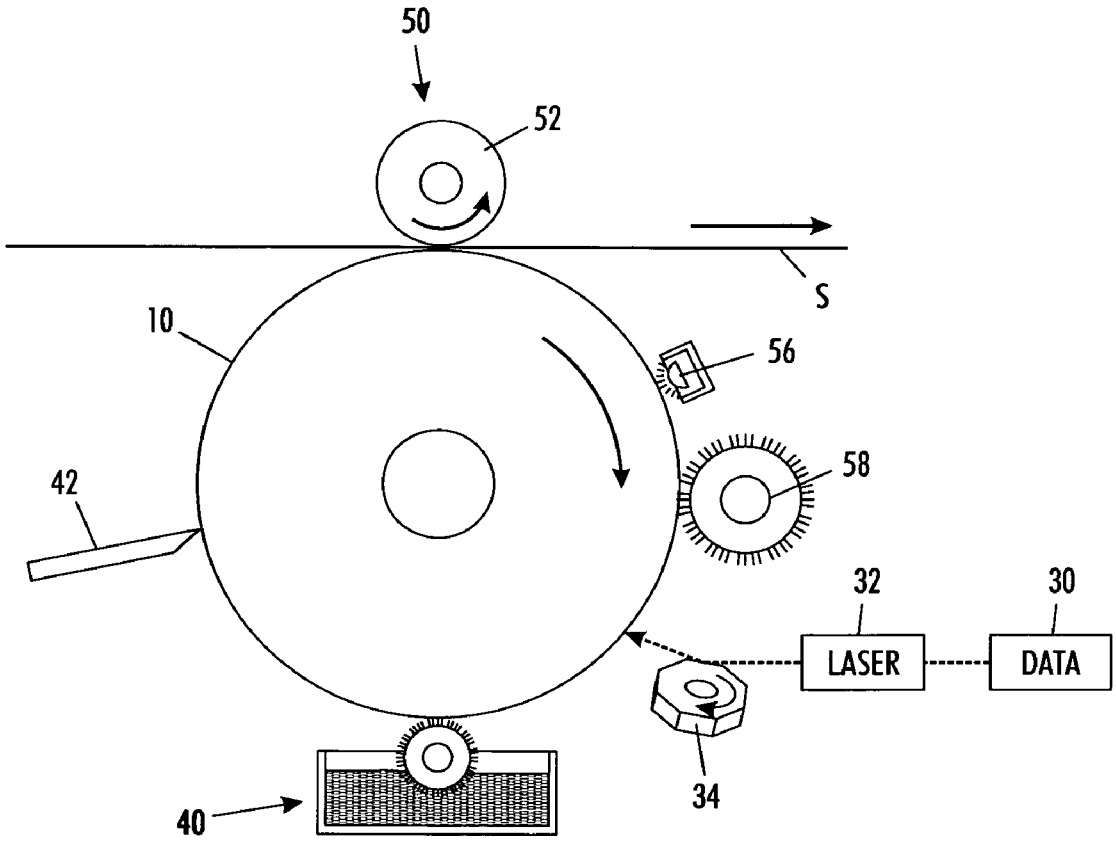
FIG. 1 is a simplified elevational view of a portion of a printing machine.

FIG. 1 is a simplified elevational view of a portion of a printing machine. In this machine, images are formed on a main surface of what can be called a "plate" indicated as 10. Although plate 10 is illustrated as a rigid cylinder, in other embodiments the plate could be in the form of a rotatable belt, or a flat platen.

Figure 2:
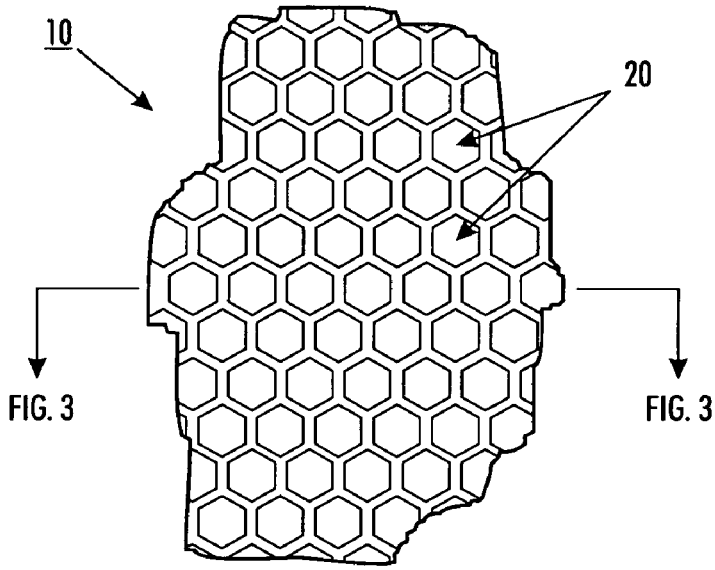
FIG. 2 is a detailed view of a portion of a main surface of a plate on which images are to be formed.

FIG. 2 is a detailed view of a portion of a main surface of plate 10, on which images are to be formed. There is defined the main surface of plate 10 a regular array, in this embodiment a hexagonal array, of cavities, here indicated as 20, which open out to the main surface of plate 10. Each cavity 20 forms an imageable area of a size comparable to a desired spatial resolution of images created with the plate 10, as will be described in detail below.

Figure 3:
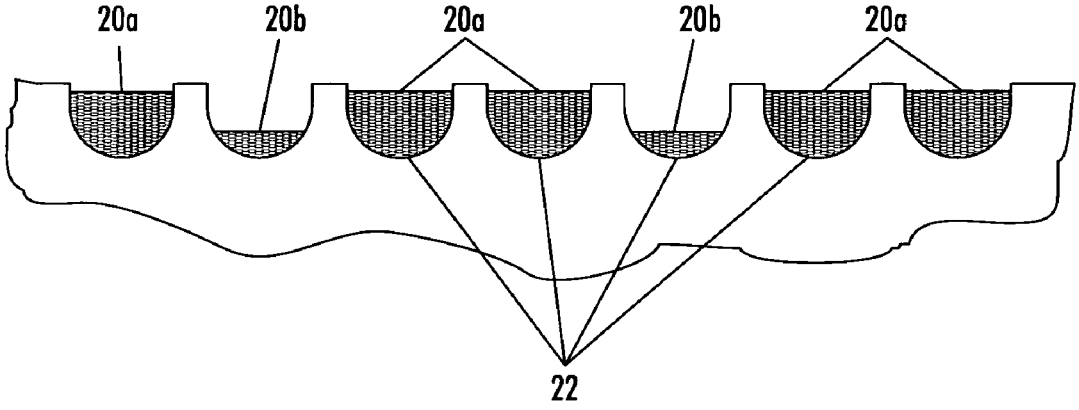
FIG. 3 is a sectional view through line 3-3 in FIG. 2.

FIG. 3 is a sectional view through line 3-3 in FIG. 2, showing some cavities in the main surface of the plate 10. In the illustrated embodiment, each cavity 20 includes therein a quantity 22 of a material capable of changing at least one of shape or volume in response to energy applied thereto. In one embodiment, the material 22 in each cavity 20 decreases in volume when exposed to an ultraviolet ray of predetermined wavelength, such as a laser, directed at the cavity. When the material 22 decreases in volume, more effectively empty space is left in the cavity. FIG. 3 shows some cavities 20*a* in which the material 22 is at its full size, substantially filling the cavity 20*a*, and other cavities 20*b*, wherein the material 22, having been exposed to ultraviolet radiation, is at least temporarily shrunken, leaving effectively empty space within the cavity 20*b*. Types of materials having this property will be described in detail below.

In overview, the plate 10, defining a large number of pixel-size cavities 20 in the main surface thereof, is able to retain marking material (typically, but not necessarily, liquid ink) in an imagewise fashion thereon. The cavities such as 20*b* in FIG. 3, having a shrunken material 22 therein, are capable of retaining ink in the balance of the available volume thereof. Cavities 20*a*, where the material 22 substantially fills the entire cavity, are effectively incapable of retaining ink. Therefore, by controlling which cavities are in a configuration such as 20*b* (capable of retaining ink) or 20*a* (largely incapable of retaining ink), one can form an ink-based image on a portion of the main surface of plate 10.

Returning to FIG. 1, the plate 10 is in the form of a rotatable cylinder. Image data, relating to an image desired to be printed, originates in a controller 30 and is used to modulate a laser 32, which in turn is reflected from a rotating mirror 34 to create a raster image, in a manner largely similar to that used in discharging a photoreceptor in a xerographic "laser" printer. The laser 32, in this embodiment, is of a predetermined ultraviolet wavelength that, when applied to material 22 in cavities 20 in the main surface of plate 10, causes the material 22 to shrink, and become of a configuration such as 20*b* in FIG. 3, and capable of retaining ink therein. Those cavities 20 which are not affected by laser 32 (i.e., the modulating laser is "off" when the beam is positioned near the particular cavity 20) remain in the configuration such as 20*a* in FIG. 3, and are not capable of retaining ink therein. The laser 32 is thus controlled to be "on" in positions corresponding to dark or inked areas of the image desired to be printed.

Downstream of laser 32 along the illustrated process direction of plate 10, the main surface of plate 10 is inked by an inking station generally indicated as 40. Inking station 40, which can be of any of variety of configurations as is generally known in, for example, offset printing, applies ink to the main surface of plate 10, so that ink is retained in the cavities of configuration 20*b* in FIG. 3. The surface of plate 10 is then metered, such as by a metering blade 42, downstream of inking station 40 along the process direction. The imagewise-disposed ink in cavities 20*b* can then be transferred to a print sheet or other ink-receiving member.

At transfer station 50, in the illustrated embodiment, a print sheet S is brought into contact with the inked main surface of plate 10, to receive the ink in imagewise fashion therefrom. A pressure roller 52 is shown, but other mechanisms having the desired transfer effect are known generally in the printing art. Alternatively, instead of transferring the ink directly to a print sheet, there may be provided a "blanket roll" (not shown), as is generally familiar in offset printing, which would receive the ink and in turn transfer it to a print sheet.

Following transfer, excess ink is removed from the main surface of plate 10 so that the plate 10 can pick up a new image in a following cycle. In the present embodiment, with the energy-sensitive material that will be described below, application of light of a predetermined wavelength, such as from lamp 56, will cause the material 22 to return to its full size, thus pushing ink out of each cavity 20. Ink remaining generally on the surface of plate 10 can then be removed by brush 58, or equivalent. The fact the material 22 can selectably expand and contract, or selectably change its position, enables a particular cavity 20 to selectably retain more or less marking material therein following the application of energy of a particular type, whether from laser 32 or lamp 56. In this way, the surface of plate 10 can be made erasable via lamp 56 and re-imageable via laser 32. This erasing and re-imaging can occur with every rotation of the cylindrical or otherwise rotatable plate 10.

In alternate embodiments, a control system can operate the illustrated apparatus to enable multiple inking and printing cycles of the rotatable plate 10, to make multiple identical images, before the image manifest in the cavities 20 is erased by lamp 56. The properties of the material 22 can be selected depending on whether it will be desired to provide multiple inking and printing cycles, and whether such multiple cycles will be very long term, such as hundreds or thousands of prints made before re-imaging.

Material 22 comprises, in one embodiment, a "light-induced shape-memory polymer." Examples of such materials are described in a letter appearing in *Nature*, Vol. 434, pp. 879-882 (14 Apr. 2005). Materials such as those described in the article have the property of changing shape, or in some arrangements position, when exposed to light of different frequencies, typically ultraviolet.

The bulk of plate 10, in which the cavities 20 are defined, can comprise ceramic, aluminum, copper, carbon, or any other suitable material. A relevant consideration of the material for plate 10 is that it is suitable for permanent attachment of material 22, such as with an adhesive.

Although the present embodiment includes a material that changes its shape or volume depending on the application of radiant energy of a predetermined wavelength, other approaches to obtaining the desired effect of each imageable area being capable of changing an amount of marking material disposable thereat, in response to energy applied thereto, can be envisioned. It is conceivable to provide a material that becomes more or less absorbent of an applied liquid depending on the application of different types of energy, radiant or otherwise, applied thereto. The pixel-sized cavities shown in the illustrated embodiment may not be required. Micromechanical structures providing the effect could be provided.

Figure 4:
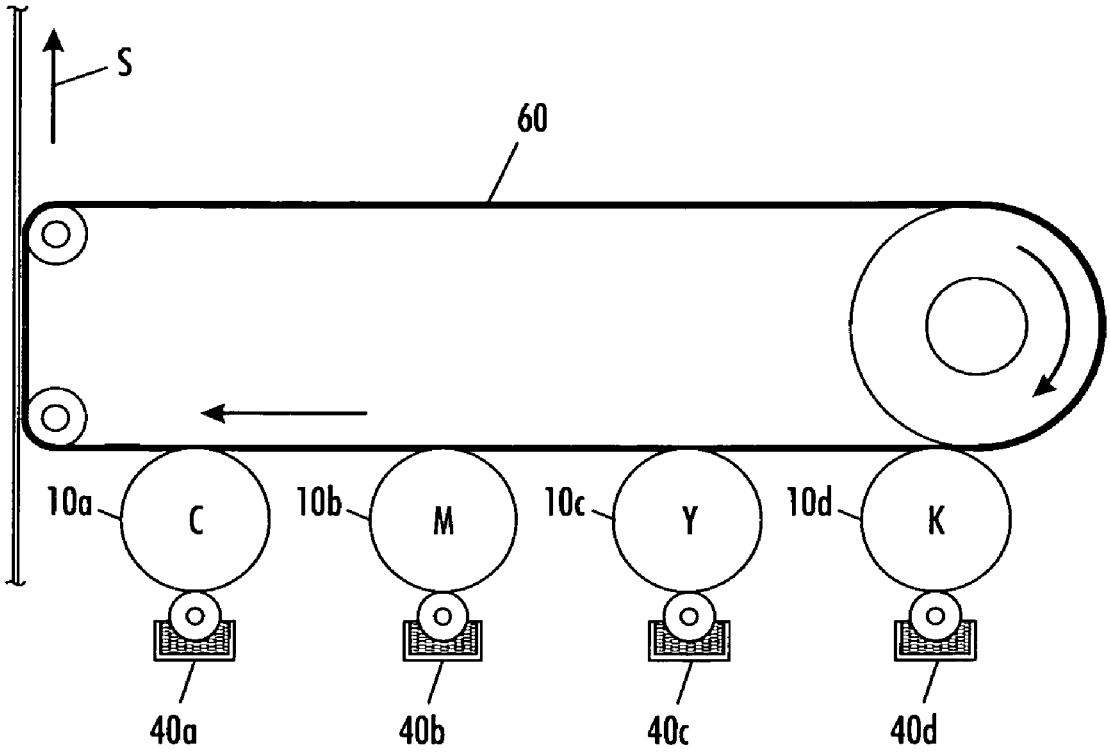
FIG. 4 is a simplified view of an architecture for a full-color version of a printer.

FIG. 4 is a simplified view of an architecture for a full-color version of a printer using the above-described technology. Here, four cylindrical plates, 10*a-d*, with corresponding inking stations 40*a-d* and other ancillary hardware (not shown) transfer imagewise-disposed inks onto an intermediate belt 60. If each inking station is provided with a different primary color ink (such as CMYK), color separations of a desired image can be accumulated on the intermediate belt and then transferred together to a print sheet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for printing an image, comprising:

a printing plate, the printing plate defining in a main surface thereof an arrangement of imageable areas, each imageable area being capable of changing an amount of marking material retainable thereat, in response to radiant energy applied thereto;

each imageable area being of a size consistent with a desired printing resolution and having at least one cavity associated therewith, each cavity being capable of selectably increasing or decreasing an amount of marking material disposable therein, in response to radiant energy applied thereto, each cavity containing therein a quantity of energy-sensitive material comprising a light-induced shape-memory polymer which, when at a full size and when shrunken, is disposed entirely within the cavity below the main surface of the plate;

an exposure device including a laser for applying ultraviolet light to at least a portion of the main surface of the printing plate, each cavity exposed to the ultraviolet radiation being able to contain more marking material due to the light-induced shape-memory polymer contained therein decreasing in volume; and an erase device including an emitter for applying radiation of a predetermined frequency to the main surface of the printing plate following a transfer operation, each cavity exposed to the radiation of a predetermined frequency being able to retain less marking material due to the light-induced shape-memory polymer contained therein increasing in volume, whereby erasing of the printing plate is effected without contact by a solid member.

2. The apparatus of claim 1, the arrangement of imageable areas being substantially regular.

3. The apparatus of claim 1, the arrangement of imageable areas being substantially hexagonal.

4. The apparatus of claim 1, the printing plate forming a substantially cylindrical main surface.

5. The apparatus of claim 1, the printing plate being in a form of a belt.

6. The apparatus of claim 1, the exposure device including a modulator for operating the laser based on digital data relating to an image desired to be printed.

7. The apparatus of claim 1, further comprising an inking station for applying ink to a portion of the main surface of the printing plate.

8. The apparatus of claim 7, the printing plate configured whereby, after the material associated with the imageable area receives energy, the imageable area is capable of retaining a greater quantity of ink from the inking station.

9. The apparatus of claim 7, the inking station including an inking roll.

10. The apparatus of claim 1, further comprising a transfer device for transferring ink in imagewise fashion from a portion of the main surface.

11. The apparatus of claim 10, the transfer device including a roll for urging a print sheet against the portion of the main surface.

12. The apparatus of claim 10, the transfer device including an intermediate member for accepting ink in imagewise fashion from the printing plate.

13. The apparatus of claim 1, wherein a bulk of the printing plate in which the cavities are defined comprises aluminum or copper.

14. The apparatus of claim 1, wherein a bulk of the printing plate in which the cavities are defined comprises ceramic material.

15. The apparatus of claim 1, wherein a bulk of the printing plate in which the cavities are defined comprises carbon.

16. The apparatus of claim 1, wherein the light-induced shape-memory polymer contained in the cavities is permanently attached to the printing plate.

17. The apparatus of claim 1, wherein the light-induced shape-memory polymer substantially fills cavities in which the light-induced shape-memory polymer is at the full size, whereby the substantially-filled cavities are effectively incapable of retaining the marking material.

18. An apparatus for printing an image, comprising:

a printing plate, including a main surface defining an arrangement of imageable areas, each imageable area being capable of changing an amount of marking material retainable thereat, in response to radiant energy applied thereto;

each imageable area having at least one cavity associated therewith, each cavity being capable of selectably increasing or decreasing an amount of marking material disposable therein, in response to radiant energy applied thereto, each cavity containing therein a separate quantity of energy-sensitive material comprising a light-induced shape-memory polymer which, when at a full size and when shrunken, is disposed entirely within the cavity;

an exposure device including a laser for emitting ultraviolet light onto at least a portion of the main surface of the printing plate causing each cavity exposed to the ultraviolet light to be able to contain more of the marking material due to the light-induced shape-memory polymer contained in each cavity exposed to the ultraviolet light decreasing in volume; and an erase device for emitting radiation of a predetermined frequency onto the main surface of the printing plate following a transfer operation, the radiation causing each cavity exposed to the radiation to be able to retain less marking material due to the light-induced shape-memory polymer contained in each cavity exposed to the radiation increasing in volume.

19. The apparatus of claim 18, wherein a bulk of the printing plate in which the cavities are defined comprises aluminum or copper.

20. The apparatus of claim 18, wherein a bulk of the printing plate in which the cavities are defined comprises ceramic material.

21. The apparatus of claim 18, wherein a bulk of the printing plate in which the cavities are defined comprises carbon.

22. The apparatus of claim 18, wherein the light-induced shape-memory polymer contained in the cavities is permanently attached to the printing plate.

23. The apparatus of claim 18, wherein the light-induced shape-memory polymer substantially fills cavities in which the light-induced shape-memory polymer is at the full size, whereby the substantially-filled cavities are effectively incapable of retaining the marking material.

24. The apparatus of claim 18, further comprising:

an inking station for applying ink to a portion of the main surface of the printing plate after the exposure device emits ultraviolet light onto at least the portion of the main surface, the main surface being substantially cylindrical; and a transfer device for transferring the ink in imagewise fashion from a portion of the main surface to a print sheet;

wherein, when the printing plate is rotated, the erase device is located to emit radiation of the predetermined frequency onto the main surface of the printing plate following the transfer operation and before the exposure device emits ultraviolet light onto at least the portion of the main surface.

25. The apparatus of claim 18, wherein each cavity forms an imageable area of a size consistent with a desired printing resolution.

26. An apparatus for printing an image, comprising:

a printing plate including a main surface defining a plurality of cavities, each cavity forming an imageable area of a size consistent with a desired printing resolution, and each cavity containing therein a separate quantity of energy-sensitive material comprising a light-induced shape-memory polymer;

an exposure device including a laser for emitting ultraviolet light onto at least a portion of the main surface of the printing plate, the ultraviolet light causing each cavity exposed thereto to be able to contain more of an ink due to the light-induced shape-memory polymer contained therein decreasing in volume entirely within the cavity; and an erase device for emitting radiation of a predetermined frequency onto the main surface of the printing plate following a transfer operation, the radiation causing each cavity exposed thereto to be able to retain less ink due to the light-induced shape-memory polymer contained therein increasing in volume entirely within the cavity.

27. The apparatus of claim 26, further comprising:

an inking station for applying ink to a portion of the main surface of the printing plate after the exposure device emits ultraviolet light onto at least the portion of the main surface, the main surface being substantially cylindrical; and a transfer device for transferring the ink in imagewise fashion from a portion of the main surface to a print sheet;

wherein, when the printing plate is rotated, the erase device is located to emit radiation of the predetermined frequency onto the main surface of the printing plate following the transfer operation and before the exposure device emits ultraviolet light onto at least the portion of the main surface.

28. The apparatus of claim 26, wherein the light-induced shape-memory polymer substantially fills cavities in which the light-induced shape-memory polymer is at the full size, whereby the substantially-filled cavities are effectively incapable of retaining the ink.

* * * * *